US009974986B2

(12) United States Patent
Pirrone

(10) Patent No.: US 9,974,986 B2
(45) Date of Patent: May 22, 2018

(54) AUTOMATED FIRE EXTINGUISHING ASSEMBLY

(71) Applicant: Joseph Pirrone, Merrick, NY (US)

(72) Inventor: Joseph Pirrone, Merrick, NY (US)

( * ) Notice: Subject to any disclaimer, the term of this patent is extended or adjusted under 35 U.S.C. 154(b) by 0 days. days.

(21) Appl. No.: 15/261,403

(22) Filed: Sep. 9, 2016

(65) Prior Publication Data

US 2018/0071559 A1 Mar. 15, 2018

(51) Int. Cl.
*A62C 3/00* (2006.01)
*A62C 35/10* (2006.01)

(52) U.S. Cl.
CPC ..... *A62C 3/006* (2013.01); *A62C 35/10* (2013.01)

(58) Field of Classification Search
CPC ..... A62C 3/006; A62C 13/78
USPC ..... 169/65
See application file for complete search history.

(56) References Cited

U.S. PATENT DOCUMENTS

| | | | | |
|---|---|---|---|---|
| 2,214,307 | A * | 9/1940 | Mountford | A62C 13/78 169/26 |
| 4,293,082 | A * | 10/1981 | Matsueda | B67D 3/0009 222/131 |
| 4,494,465 | A * | 1/1985 | Fick, Jr. | A47B 3/083 108/131 |
| 5,619,800 | A * | 4/1997 | Unruh | G01B 5/255 33/203.15 |
| 6,310,404 | B1 | 10/2001 | Frank | |
| D597,944 | S | 8/2009 | Takamura | |
| 7,896,368 | B2 | 3/2011 | Craig et al. | |
| 8,302,976 | B2 | 11/2012 | Okabe | |
| 2009/0095105 | A1* | 4/2009 | Hollender | F24F 13/1426 74/425 |
| 2011/0095540 | A1 | 4/2011 | Jackson et al. | |
| 2014/0217689 | A1 | 8/2014 | Rumao et al. | |

* cited by examiner

*Primary Examiner* — Arthur O Hall
*Assistant Examiner* — Viet Le

(57) ABSTRACT

An automated fire extinguishing assembly for fire protection while using cooking appliances includes a fire extinguisher and a stand. The fire extinguisher is automatic. The stand is configured to couple to the fire extinguisher. The stand is positioned to couple to the fire extinguisher such that the fire extinguisher is positionable above a cooking appliance, such as a crockpot. The fire extinguisher is configured to detect a fire, self-actuate and deliver a fire suppressing agent in the event of a fire.

13 Claims, 5 Drawing Sheets

AUTOMATED FIRE EXTINGUISHING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to fire extinguishing assemblies and more particularly pertains to a new fire extinguishing assembly for fire protection while using cooking appliances.

BRIEF SUMMARY OF THE INVENTION

An embodiment of the disclosure meets the needs presented above by generally comprising a fire extinguisher and a stand. The fire extinguisher is automatic. The stand is configured to couple to the fire extinguisher. The stand is positioned to couple to the fire extinguisher such that the fire extinguisher is positionable above a cooking appliance, such as a crockpot. The fire extinguisher is configured to detect a fire, self-actuate and deliver a fire suppressing agent in the event of a fire.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
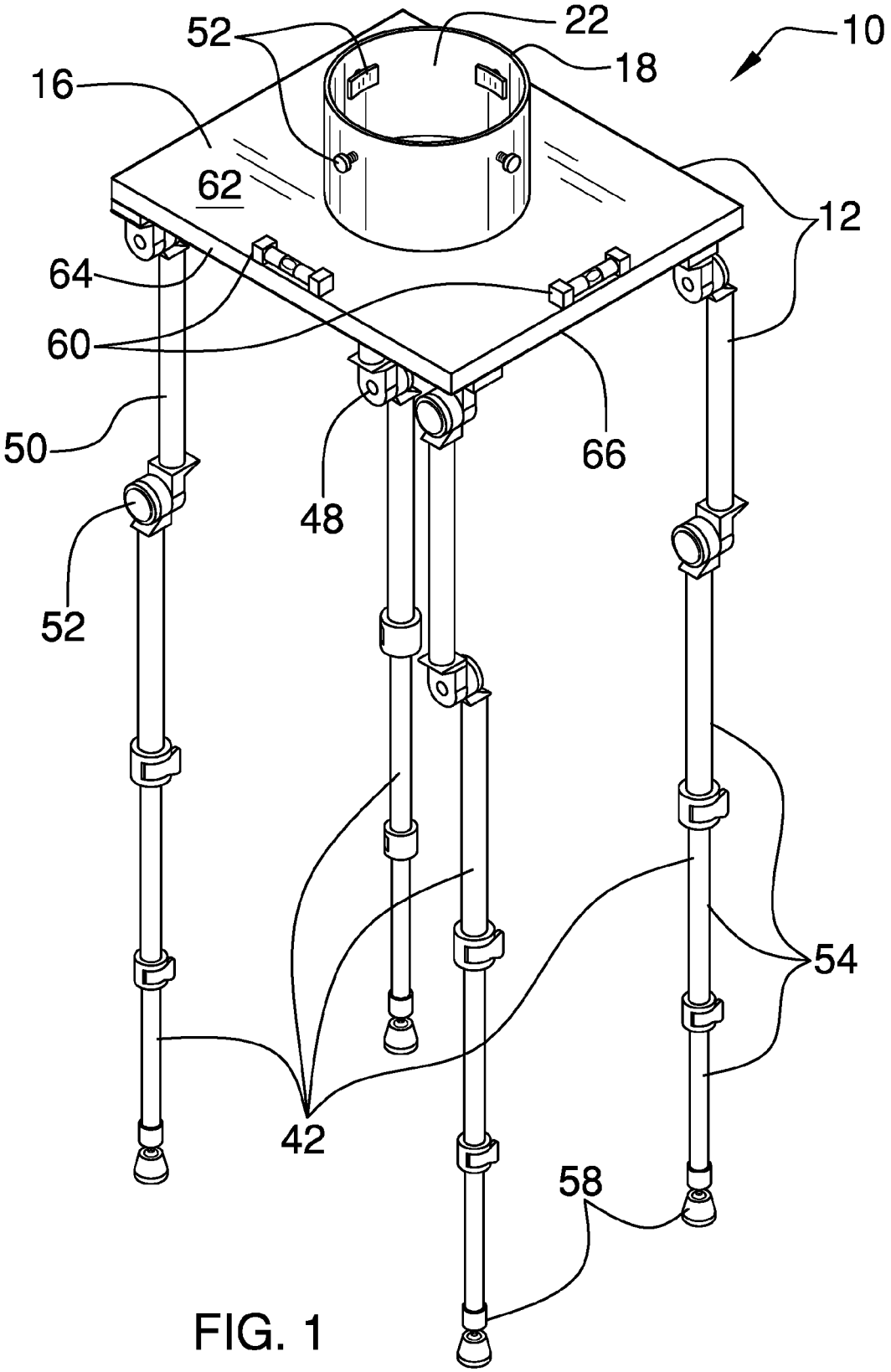
FIG. 1 is an isometric perspective view of an automated fire extinguishing assembly according to an embodiment of the disclosure.
Figure 2:
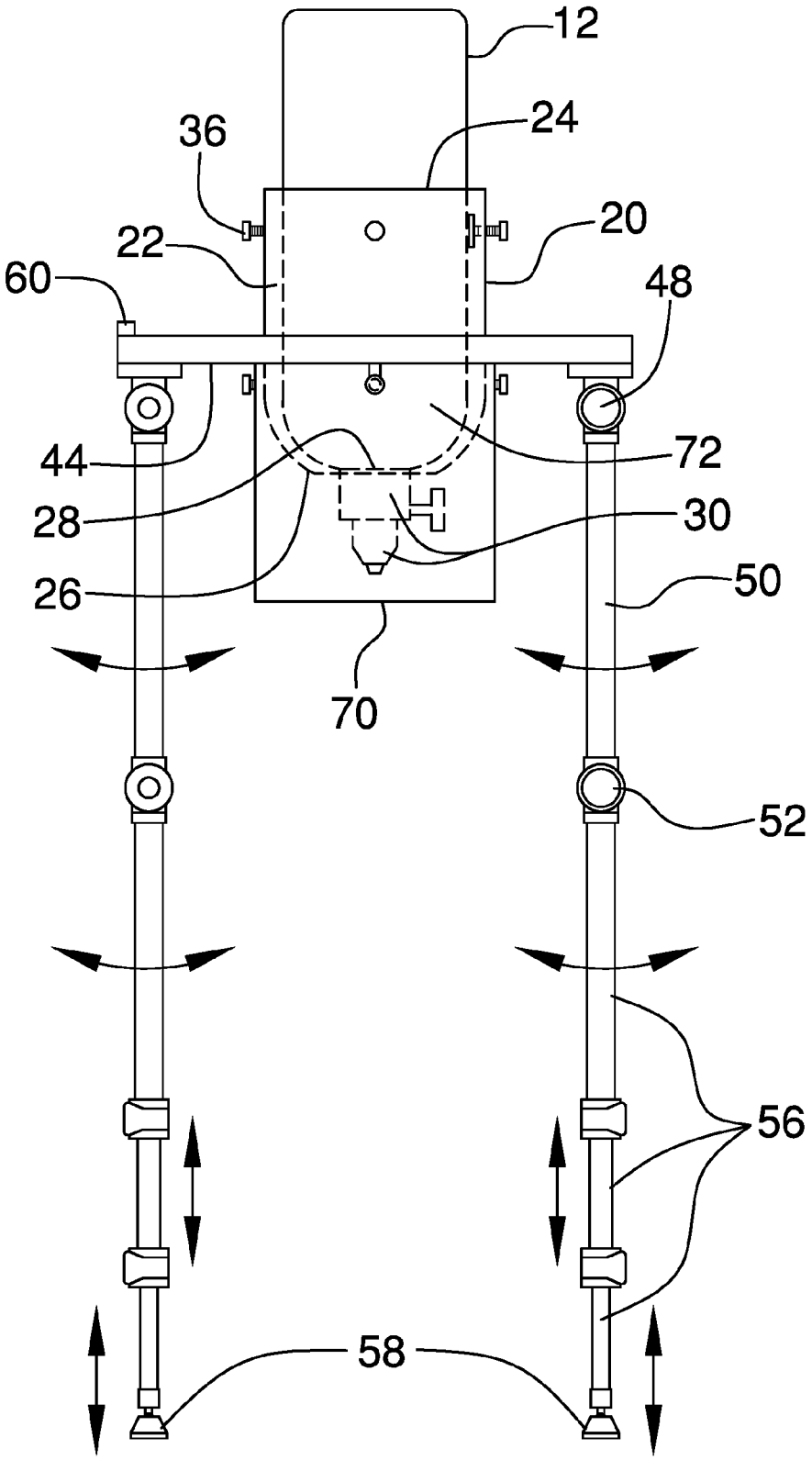
FIG. 2 is a rear view of an embodiment of the disclosure.
Figure 3:
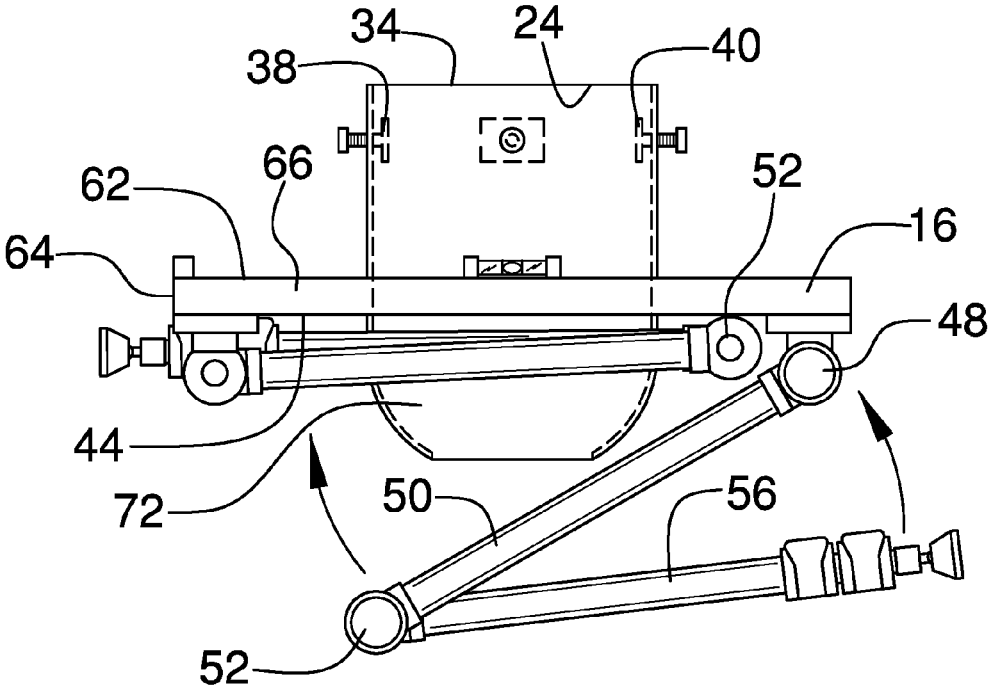
FIG. 3 is a side view of an embodiment of the disclosure.
Figure 4:
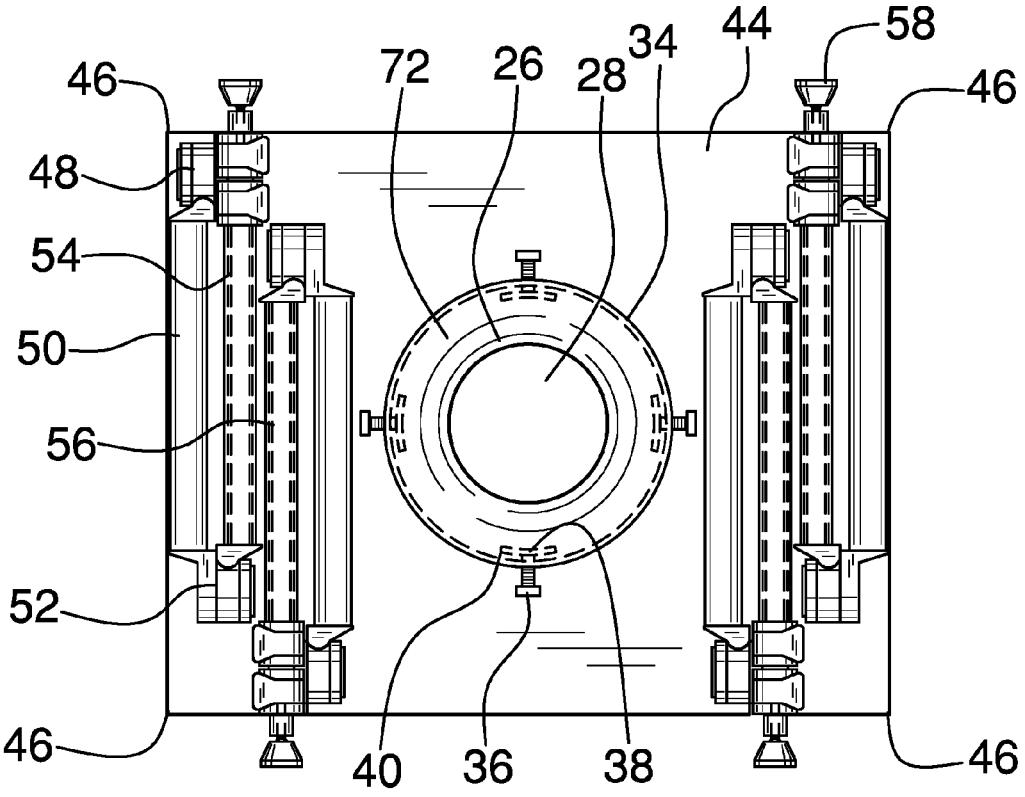
FIG. 4 is a bottom view of an embodiment of the disclosure.
Figure 5:
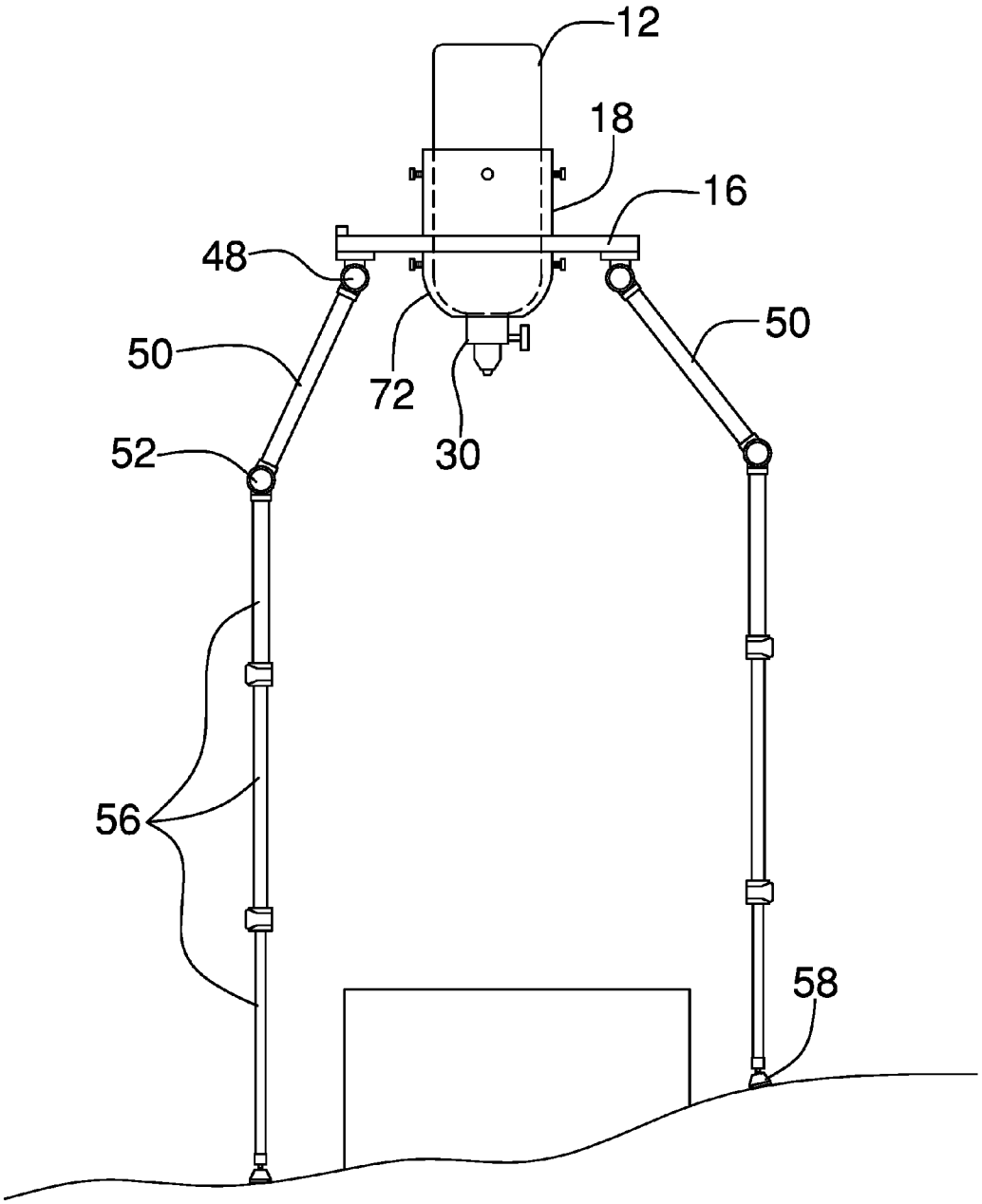
FIG. 5 is an in-use view of an embodiment of the disclosure.
Figure 6:
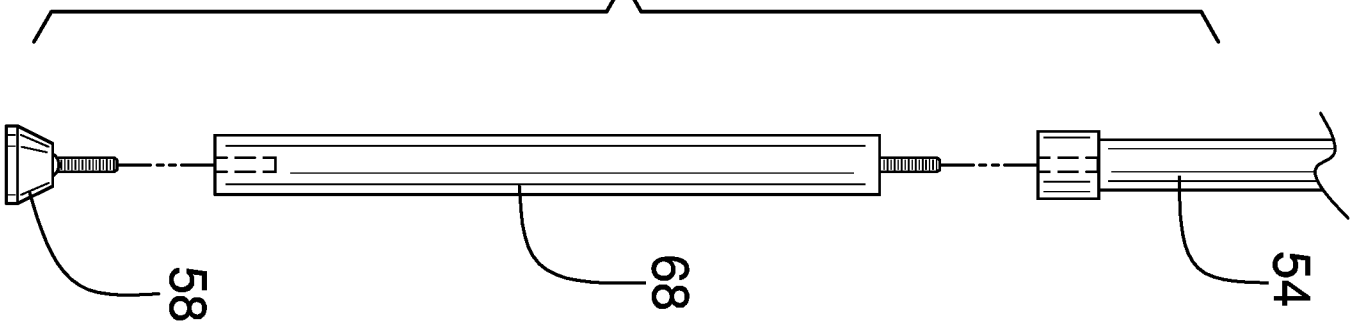
FIG. 6 is a detail view of an embodiment of the disclosure.

With reference now to the drawings, and in particular to FIGS. 1 through 6 thereof, a new fire extinguishing assembly embodying the principles and concepts of an embodiment of the disclosure and generally designated by the reference numeral 10 will be described.

As best illustrated in FIGS. 1 through 6, the automated fire extinguishing assembly 10 generally comprises a fire extinguisher 12 and a stand 14. The fire extinguisher 12 is automatic. The fire extinguisher 12 is configured to detect a fire, self-actuate and deliver a fire suppressing agent. The stand 14 is configured to couple to the fire extinguisher 12. The stand 14 is positioned to couple to the fire extinguisher 12 such that the fire extinguisher 12 is positionable above a cooking appliance such as a crockpot.

The stand 14 comprises a plate 16. In one embodiment, the plate 16 is substantially squarely shaped. A holder 18 is coupled to the plate 16. The holder 18 is substantially complementary to the fire extinguisher 12. The holder 18 is positioned on the plate 16 such that the holder 18 is positioned to couple to the fire extinguisher 12.

In one embodiment, the holder 18 comprises a cylinder 20 that is coupled to and positioned through the plate 16. The cylinder 20 defines an internal space 22. The cylinder 20 has an upper end 24 and a lower end 26. The upper end 24 is open and the lower end 26 is rounded. The cylinder 20 is positioned on the plate 16 such that the cylinder 20 is positioned for insertion of the fire extinguisher 12. A penetration 28 is positioned through the lower end 26. The penetration 28 is configured to insert a neck 30 of the fire extinguisher 12. In one embodiment, the penetration 28 is substantially circularly shaped.

A plurality of couplers 32 is coupled to the cylinder 20. The couplers 32 are configured to couple the fire extinguisher 12 to the cylinder 20. In one embodiment, the plurality of couplers 32 comprise four couplers 32 evening distributed around a circumference 34 of the cylinder 20. In another embodiment, each coupler 32 comprises a screw 36 that is threadedly coupled to the cylinder 20 proximate to the upper end 24. An inner end 38 of the screw 36 is variably positionable in the internal space 22. A bracket 40 is rotationally coupled to the inner end 38. The bracket 40 is arcuate. The screw 36 is variably positionable in the internal space 22 such that the bracket 40 is frictionally couplable to the fire extinguisher 12.

A plurality of legs 42 is coupled to and extends from a bottom 44 of the plate 16. The legs 42 are positioned on the plate 16 such that the plate 16 is positionable above the cooking appliance. In one embodiment, the plurality of legs 42 comprise legs 42 positioned singly proximate to corners 46 of the plate 16. In another embodiment, the legs 42 are hingedly coupled to the plate 16.

Each leg 42 comprises a first lock hinge 48 that is coupled to the bottom 44 of the plate 16. A rod 50 is coupled to and extends from the first lock hinge 48. The rod 50 is circularly shaped when viewed longitudinally. The first lock hinge 48 is positioned on the plate 16 such that the rod 50 is selectively positionable transverse to the plate 16 and substantially parallel to the plate 16.

A second lock hinge 52 is coupled to the rod 50 distal from the first lock hinge 48. A tube 54 is coupled to and extends from the second lock hinge 52. The tube 54 is circularly shaped when viewed longitudinally. In one embodiment, the tube 54 comprises a plurality of nested sections 56. Each nested section 56 is reversibly couplable to adjacent nested sections 56, such that the tube 54 is variably telescopic. In another embodiment, the plurality of nested sections 56 comprises three nested sections 56. The second lock hinge 52 is positioned on the rod 50 such that the tube 54 is selectively positionable transverse to the rod 50 and substantially parallel to the rod 50.

A plurality of feet 58 is reversibly couplable singly to the tubes 54 distal from the second lock hinge 52. Each foot 58 is configured to pivot relative to a respective tube 54. In one embodiment, the feet 58 comprise rubber. In another embodiment, the feet 58 are threadedly couplable to the tubes 54.

A plurality of levels 60 is coupled to a top 62 of the plate 16. The levels 60 are positioned on the plate 16 such that the levels 60 are configured for viewing by a user to assess the leveling of the plate 16. In one embodiment, the plurality of levels 60 comprise levels 60 positioned singly proximate to a front 64 and a respective opposing side 66 of the plate 16.

The assembly 10 comprises a plurality of extensions 68. Each extension 68 is circularly shaped when viewed longitudinally. Each extension 68 is selectively and threadedly couplable to a respective tube 54 distal from the second lock hinge 52. Each extension 68 is configured to threadedly couple to a respective foot 58.

The assembly 10 comprises a cover 70 that is configured for positioning over a lower section 72 of the cylinder 20 and the neck 30 of the fire extinguisher 12. The cover 70 is reversibly couplable to the cylinder 20 proximate to the bottom 44 of the plate 16. The cover 70 is positioned for insertion of the lower section 72 of the cylinder 20 and the neck 30 of the fire extinguisher 12 such that the neck 30 is protected during storage.

In use, the cylinder 20 is positioned on the plate 16 such that the cylinder 20 is positioned for insertion of the fire extinguisher 12. The screws 36 are threadedly coupled to the cylinder 20 such that the brackets 40 are frictionally couplable to the fire extinguisher 12. The legs 42 are positioned on the plate 16 such that the plate 16 and the fire extinguisher 12 are positionable above a cooking appliance, such as a crockpot. The fire extinguisher 12 is configured to detect a fire, self-actuate and deliver a fire suppressing agent in the event of a fire.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An automated fire extinguishing assembly comprising:
a fire extinguisher, said fire extinguisher being automatic;
a stand configured for coupling to said fire extinguisher, said stand comprising:
a plate,
a holder coupled to said plate, said holder being substantially complementary to said fire extinguisher, wherein said holder is positioned on said plate such that said holder is positioned to couple to said fire extinguisher, and
a plurality of legs coupled to and extending from a bottom of said plate, wherein said legs are positioned on said plate such that said plate is positionable above the cooking appliance;
wherein said stand is positioned to couple to said fire extinguisher such that said fire extinguisher is positionable above a cooking appliance, wherein said fire extinguisher is configured to detect a fire, self-actuate and deliver a fire suppressing agent; and
wherein each said leg comprises
a first lock hinge coupled to said bottom of said plate,
a rod coupled to and extending from said first lock hinge, said rod being circularly shaped when viewed longitudinally,
a second lock hinge coupled to said rod distal from said first lock hinge,
a tube coupled to and extending from said second lock hinge, said tube being circularly shaped when viewed longitudinally, said tube comprising a plurality of nested sections, each said nested section being reversibly couplable to adjacent said nested sections, such that said tube is variably telescopic, and
wherein first lock hinge is positioned on said plate such that said rod is selectively positionable transverse to said plate and substantially parallel to said plate wherein second lock hinge is positioned on said rod such that said tube is selectively positionable transverse to said rod and substantially parallel to said rod.

2. The assembly of claim 1, further including said legs being hingedly coupled to said plate.

3. The assembly of claim 1, further including said holder comprising:
a cylinder coupled to and positioned through said plate, said cylinder defining an internal space, said cylinder having an upper end and a lower end, said upper end being open, said lower end being rounded, wherein said cylinder is positioned on said plate such that said cylinder is positioned for insertion of said fire extinguisher;

a penetration positioned through said lower end, said penetration being configured for insertion of a neck of said fire extinguisher, said penetration being substantially circularly shaped; and a plurality of couplers coupled to said cylinder, said couplers being configured to couple said fire extinguisher to said cylinder.

4. The assembly of claim 3, further including said plurality of couplers comprising four said couplers evenly distributed around a circumference of said cylinder.

5. The assembly of claim 1, further comprising:

said plate being substantially squarely shaped; and said plurality of legs comprising said legs positioned singly proximate to corners of said plate.

6. The assembly of claim 1, further including said plurality of nested sections comprising three said nested sections.

7. The assembly of claim 1, further including a plurality of feet reversibly couplable singly to said tubes distal from said second lock hinge, each said foot being configured to pivot relative a respective said tube, said feet comprising rubber, said feet being threadedly couplable to said tubes.

8. The assembly of claim 7, further including a plurality of extensions, said extensions being circularly shaped when viewed longitudinally, each said extension being selectively and threadedly couplable to a respective said tube distal from said second lock hinge, each said extension being configured to threadedly couple to a respective said foot.

9. The assembly of claim 1, further including a plurality of levels coupled to a top of said plate, wherein said levels are positioned on said plate such that said levels are configured for viewing by a user to assess the leveling of said plate.

10. The assembly of claim 9, further including said plurality of levels comprising levels positioned singly proximate to a front and a respective opposing side of said plate.

11. The assembly of claim 1, further comprising:

said stand further comprising:

said plate being substantially squarely shaped, said holder comprising:

a cylinder coupled to and positioned through said plate, said cylinder defining an internal space, said cylinder having an upper end and a lower end, said upper end being open, said lower end being rounded, wherein said cylinder is positioned on said plate such that said cylinder is positioned for insertion of said fire extinguisher, a penetration positioned through said lower end, said penetration being configured for insertion of a neck of said fire extinguisher, said penetration being substantially circularly shaped, a plurality of couplers coupled to said cylinder, said couplers being configured to couple said fire extinguisher to said cylinder, said plurality of couplers comprising four said couplers evenly distributed around a circumference of said cylinder, each said coupler comprising:

a screw threadedly coupled to said cylinder proximate to said upper end such that an inner end of said screw is variably positionable in said internal space, a bracket rotationally coupled to said inner end, said bracket being arcuate, and wherein said screw is threadedly coupled to said cylinder such that said screw is variably positionable in said internal space, such that said bracket is frictionally couplable to said fire extinguisher, and said plurality of legs comprising said legs positioned singly proximate to corners of said plate, said legs being hingedly coupled to said plate, each said leg further comprising said plurality of nested sections comprising three said nested sections;

a plurality of feet reversibly couplable singly to said tubes distal from said second lock hinge, each said foot being configured to pivot relative a respective said tube, said feet comprising rubber, said feet being threadedly couplable to said tubes;

a plurality of levels coupled to a top of said plate, wherein said levels are positioned on said plate such that said levels are configured for viewing by a user to assess the leveling of said plate, said plurality of levels comprising levels positioned singly proximate to a front and a respective opposing side of said plate;

a plurality of extensions, said extensions being circularly shaped when viewed longitudinally, each said extension being selectively and threadedly couplable to a respective said tube distal from said second lock hinge, each said extension being configured to threadedly couple to a respective said foot;

a cover configured for positioning over a lower section of said cylinder and said neck of said fire extinguisher, said cover being reversibly couplable to said cylinder proximate to said bottom of said plate, wherein said cover is positioned for insertion of said lower section of said cylinder and said neck of said fire extinguisher such that said neck is protected during storage; and wherein said cylinder is positioned on said plate such that said cylinder is positioned for insertion of said fire extinguisher, wherein said screw is threadedly coupled to said cylinder such that said bracket is frictionally couplable to said fire extinguisher, wherein said legs are positioned on said plate such that said plate and said fire extinguisher are positionable above a cooking appliance such, such as a crockpot, wherein said fire extinguisher is configured to detect a fire, self-actuate and deliver a fire suppressing agent in the event of a fire.

12. An automated fire extinguishing assembly comprising:

a fire extinguisher, said fire extinguisher being automatic;

a stand configured for coupling to said fire extinguisher, said stand comprising:

a plate, a holder coupled to said plate, said holder being substantially complementary to said fire extinguisher, wherein said holder is positioned on said plate such that said holder is positioned to couple to said fire extinguisher, said holder comprising a cylinder coupled to and positioned through said plate, said cylinder defining an internal space, said cylinder having an upper end and a lower end, said upper end being open, said lower end being rounded, wherein said cylinder is positioned on said plate such that said cylinder is positioned for insertion of said fire extinguisher, a penetration positioned through said lower end, said penetration being configured for insertion of a neck of said fire extinguisher, said penetration being substantially circularly shaped, and a plurality of couplers coupled to said cylinder, said couplers being configured to couple said fire extinguisher to said cylinder, each said coupler comprising a screw threadedly coupled to said cylinder proximate to said upper end such that an inner end of said screw is variably positionable in said internal space, a bracket rotationally coupled to said inner end, said bracket being arcuate, and wherein said screw is threadedly coupled to said cylinder such that said screw is variably positionable in said internal space, such that said bracket is frictionally couplable to said fire extinguisher, and a plurality of legs coupled to and extending from a bottom of said plate, wherein said legs are positioned on said plate such that said plate is positionable above the cooking appliance; and wherein said stand is positioned to couple to said fire extinguisher such that said fire extinguisher is positionable above a cooking appliance, wherein said fire extinguisher is configured to detect a fire, self-actuate and deliver a fire suppressing agent.

13. An automated fire extinguishing assembly comprising:

a fire extinguisher, said fire extinguisher being automatic;

a stand configured for coupling to said fire extinguisher, said stand comprising:

a plate, a holder coupled to said plate, said holder being substantially complementary to said fire extinguisher, wherein said holder is positioned on said plate such that said holder is positioned to couple to said fire extinguisher, said holder comprising a cylinder coupled to and positioned through said plate, said cylinder defining an internal space, said cylinder having an upper end and a lower end, said upper end being open, said lower end being rounded, wherein said cylinder is positioned on said plate such that said cylinder is positioned for insertion of said fire extinguisher, a penetration positioned through said lower end, said penetration being configured for insertion of a neck of said fire extinguisher, said penetration being substantially circularly shaped, and a plurality of couplers coupled to said cylinder, said couplers being configured to couple said fire extinguisher to said cylinder, and a plurality of legs coupled to and extending from a bottom of said plate, wherein said legs are positioned on said plate such that said plate is positionable above the cooking appliance;

wherein said stand is positioned to couple to said fire extinguisher such that said fire extinguisher is positionable above a cooking appliance, wherein said fire extinguisher is configured to detect a fire, self-actuate and deliver a fire suppressing agent; and a cover configured for positioning over a lower section of said cylinder and said neck of said fire extinguisher, said cover being reversibly couplable to said cylinder proximate to said bottom of said plate, wherein said cover is positioned for insertion of said lower section of said cylinder and said neck of said fire extinguisher such that said neck is protected during storage.

* * * * *